US005412551A

United States Patent [19]

Newell

[11] Patent Number: 5,412,551

[45] Date of Patent: May 2, 1995

[54] LUMINAIRE FIXTURE

[75] Inventor: Alan A. Newell, Sussex, N.J.

[73] Assignee: Mark Lighting Co., Inc., Moonachie, N.J.

[21] Appl. No.: 153,818

[22] Filed: Nov. 15, 1993

[51] Int. Cl.[6] ..... F21V 7/12

[52] U.S. Cl. ..... 362/241; 362/217; 362/260; 362/290; 362/297; 362/346; 359/850

[58] Field of Search ..... 362/217, 219, 225, 235, 362/240, 241, 249, 260, 290, 297, 346; 359/850

[56] References Cited

U.S. PATENT DOCUMENTS

| | | | |
|---|---|---|---|
| 4,336,576 | 6/1982 | Crabtree | 362/240 |
| 4,388,675 | 6/1983 | Lewin | 362/225 |
| 4,499,529 | 2/1985 | Figueroa | 362/283 |
| 4,669,033 | 5/1987 | Lee | 362/217 |
| 4,729,075 | 3/1988 | Brass | 362/217 |
| 4,760,505 | 7/1988 | Cole, Jr. | 362/225 |
| 4,796,168 | 1/1989 | Peterson | 362/217 |
| 4,814,954 | 3/1989 | Spitz | 362/217 |
| 4,855,883 | 8/1989 | Spitz | 362/260 |
| 4,907,143 | 3/1990 | Lasker | 362/225 |
| 5,038,254 | 9/1991 | Fabri et al. | 362/33 |
| 5,062,030 | 10/1991 | Figueroa | 362/346 |
| 5,134,553 | 7/1992 | Hasegawa | 362/223 |
| 5,183,327 | 2/1993 | Fabbri | 362/219 |
| 5,272,608 | 12/1993 | Engle | 362/217 |
| 5,274,533 | 12/1993 | Neary et al. | 362/260 |

*Primary Examiner*—Ira S. Lazarus
*Assistant Examiner*—Sara Sachie Raab
*Attorney, Agent, or Firm*—Weingram & Zall

[57] ABSTRACT

A luminaire fixture is provided which evenly illuminates shelves positioned along an aisle. The luminaire fixture includes a reflector generally having the shape of a flattened, elongated V. The outer edges of the V are bent to extend horizontal for a distance and then bend down forming a 270° angle with the horizontal portion forming two end walls. Positioned below the reflector, near the end walls, are fluorescent lamps. Positioned directly above the point of the V is another light source for providing upward to provide an upward illumination.

15 Claims, 5 Drawing Sheets

LUMINAIRE FIXTURE

BACKGROUND OF THE INVENTION

1. Field of the Invention

The present invention relates to a luminaire fixture and in particular to a luminaire fixture for use with fluorescent lamps for providing illumination in a commercial setting, and more particularly to provide overhead light to shelves arranged in aisles.

2. Description of the Prior Art

Fluorescent lamps emit light in all directions. When attempting to direct light from a fluorescent lamp, a reflector is usually positioned about the lamp to reflect the light in a desired direction.

Many of the fluorescent light fixtures in the prior art provide light in a single direction. As such, these prior art apparatus include reflectors mounted partially about the fluorescent lamp. Such fixtures are not entirely appropriate for properly lighting shelves arranged in aisles in a commercial facility. For example, in grocery stores, the prior art light fixtures are unable to evenly light all of the shelves along an aisle.

Some of the fluorescent light fixtures set forth in the prior art are as follows:

Crabtree, U.S. Pat. No. 4,336,576, discloses a lighting apparatus that uses less light sources to produce an equivalent illumination. The apparatus includes a reflector designed or shaped to reflect light from one light source to concentrate the reflection from the back and sides of that light source to give the appearance of the existence of a second light source in the apparatus.

Figueroa, U.S. Pat. No. 4,499,529, discloses a light reflector for use in a fluorescent lamp which includes an M-shaped reflector having a central V section and two wing sections angling out from the V section.

Lee, U.S. Pat. No. 4,669,033, discloses an adjustable reflector for a fluorescent light having a plurality of facets extending along the length of the reflector. The facets are hingedly joined together so that they may be oriented to a desired focusing relationship.

Brass, U.S. Pat. No. 4,729,075, discloses a reflector for creating a torodial light pattern. The reflector has continuous flat facets shaped at a V above the light source and extending up and then around and down past the light source.

Cole, Jr., U.S. Pat. No. 4,760,505, discloses a fluorescent light having multiple, vertically stacked fluorescent lights with a V-shaped reflectors extending along the side thereof for illuminating a ceiling.

Peterson, U.S. Pat. No. 4,796,168, discloses a fluorescent light having a reflector having an upper relatively strong-curved portion that passes into a lower less-curved portion. The lamp is placed within the upper strong-curved portion. The shape of the reflector provides uniform lighting and efficient lighting.

Spitz, U.S. Pat. No. 4,814,954, discloses a fluorescent light having a reflector with multiple elongated strip-like planar mirror surfaces.

Spitz, U.S. Pat. No. 4,855,883, discloses a fluorescent light having a reflector with multiple elongated strip-like planar mirror surfaces. The reflector above the light is in the shape of a shallow V that extends out a short distance beyond the light, the multiple surfaces then curving down around the light source. Note that columns 5 and 6 were missing from our copy of this patent.

Lasker, U.S. Pat. No. 4,907,143, discloses a reflector for a fluorescent light having a pair of vertically stacked light sources. An upper reflector system directs light originating with the lamp outwardly from the fixture in multiple directions.

Fabri, et al., U.S. Pat. No. 5,038,254, discloses a fluorescent light for use in a medical lighting system. The system includes a ceiling mounted light having a reading light, an examination light and an ambient light.

Figueroa, U.S. Pat. No. 5,062,030, discloses a fluorescent light having a reflector comprising a series of light reflected angled planar surfaces symmetrically joined to a central section. The sections are capable of directing light rays downwardly and uniformly in a more intense manner than previous fluorescent lights. The angled planar reflecting surfaces define a generally concave contour.

Hasegawa, U.S. Pat. No. 5,134,553, discloses a fluorescent light having a reflector having an overall configuration of an M shape with outstanding wings attached to each end. The purpose of the reflector configuration is to obtain a uniform brightness on a transparent advertising surface.

None of these prior art patents, taken either singly or in combination, teach or suggest all of the elements and benefits of the luminaire fixture of the present invention.

SUMMARY AND OBJECT OF THE INVENTION

The luminaire fixture of the present invention may be used in a commercial setting for illuminating items on shelves arranged in aisles in, for example, grocery stores. Typically, the luminaire fixture is suspended from the ceiling above the aisle. The luminaire fixture of this invention provides illumination to the floor of the aisle and to the shelves positioned along the aisle.

The luminaire fixture of the present invention includes a reflector generally having the shape of a flattened, elongated V. The outer edges of the V are bent to extend horizontally for a relatively short distance and then bend down forming a 270° angle with the horizontal portion to form end walls. As such, the reflector of the luminaire fixture of the present invention forms two generally triangular areas which meet at the point of the V.

Positioned within the triangular areas of the reflector are light sources. Typically, these are elongated fluorescent lamps. Depending upon the size of the fixture, one or more lamps may be placed, end to end, in each of the triangular areas of the reflector. Additionally, another light source may be placed directly above the point of the V, above the reflector. This upper light source is used to direct light upward to provide an upward illumination of the store aisle to "expand" the area above an aisle, and/or to illuminate the ceiling of an aisle.

The shape of the reflector, as herein described, reflects light from the fluorescent lamps to the shelves forming an aisle, providing even illumination to the top and bottom shelves as well as the shelves therebetween. Further, light is provided to the floor of the aisle.

Additionally, the luminaire fixture of the present invention can be attached to additional fixtures to form a continuous series of luminaire fixtures that may extend along the entire length of an aisle. The fixtures are designed so that required ballasts can be disposed within the fixtures. Typically the ballasts are positioned above the reflector and along the axis of the upper light source, either fore or aft of the upper light source.

Accordingly, it is an object of the luminaire fixture of the present invention to provide light to shelves forming an aisle.

It is another object of the invention to provide evenly distributed light to shelves forming an aisle.

It is even another object of the light fixture of this invention to provide evenly distributed light to shelves from a position above the aisle formed by the shelves.

It is still another object of this invention to provide a luminaire fixture having a conventional size housing which can provide evenly distributed light to shelves from a position located above an aisle formed by the shelves.

It is yet another object of the luminaire fixture of the present invention to have a reflector in the shape of a flattened V having a point, angled walls extending outward, a horizontal portion, and vertical end walls for directing light from fluorescent lamps to light shelves forming an aisle.

It is a further object of this invention to provide a luminaire fixture having an up light for lighting the ceiling above an aisle.

It is still a further object of the present invention to provide a luminaire fixture that can be interconnected with other luminaire fixtures to provide a continuous series luminaire fixtures extending along an aisle.

It is even a further object of the present invention to provide a luminaire fixture that may be suspended from a ceiling above an aisle.

It is an additional object of this invention to provide a luminaire fixture having a reflector for directing fluorescent light to evenly light facing shelves from a position above the shelves, while also reflecting fluorescent light in an upward direction to illuminate the ceiling above the shelves.

These as well as further objects and advantages of this invention will become apparent to those skilled in the art from a review of the accompanying detailed description of the preferred embodiment, reference being made to the accompanying drawings.

BRIEF DESCRIPTION OF THE DRAWINGS

The invention will be described with reference to the accompanying drawings in which.

DETAILED DESCRIPTION OF THE INVENTION

Figure 1:
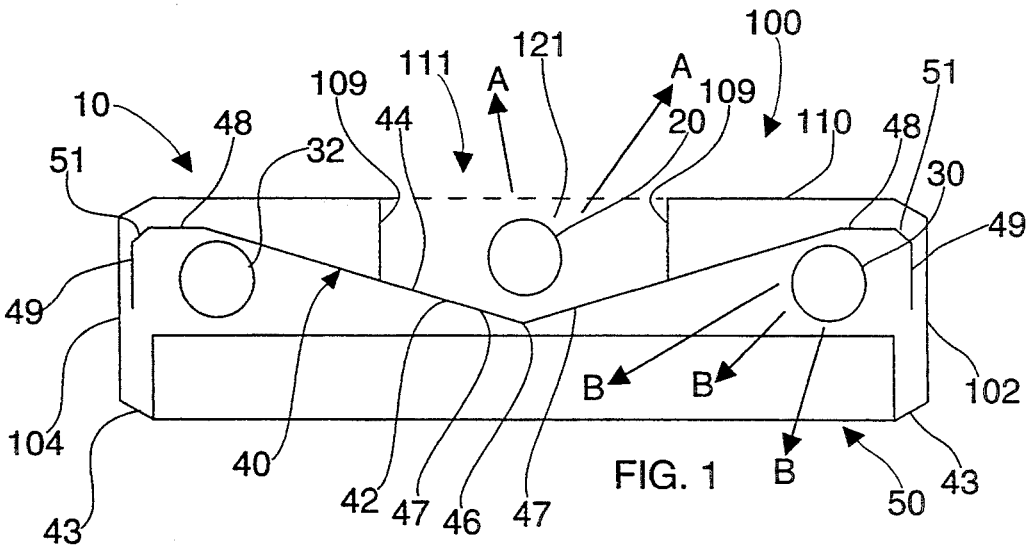
FIG. 1 is a cross-sectional view of the luminaire fixture of the present invention.
Figure 2:
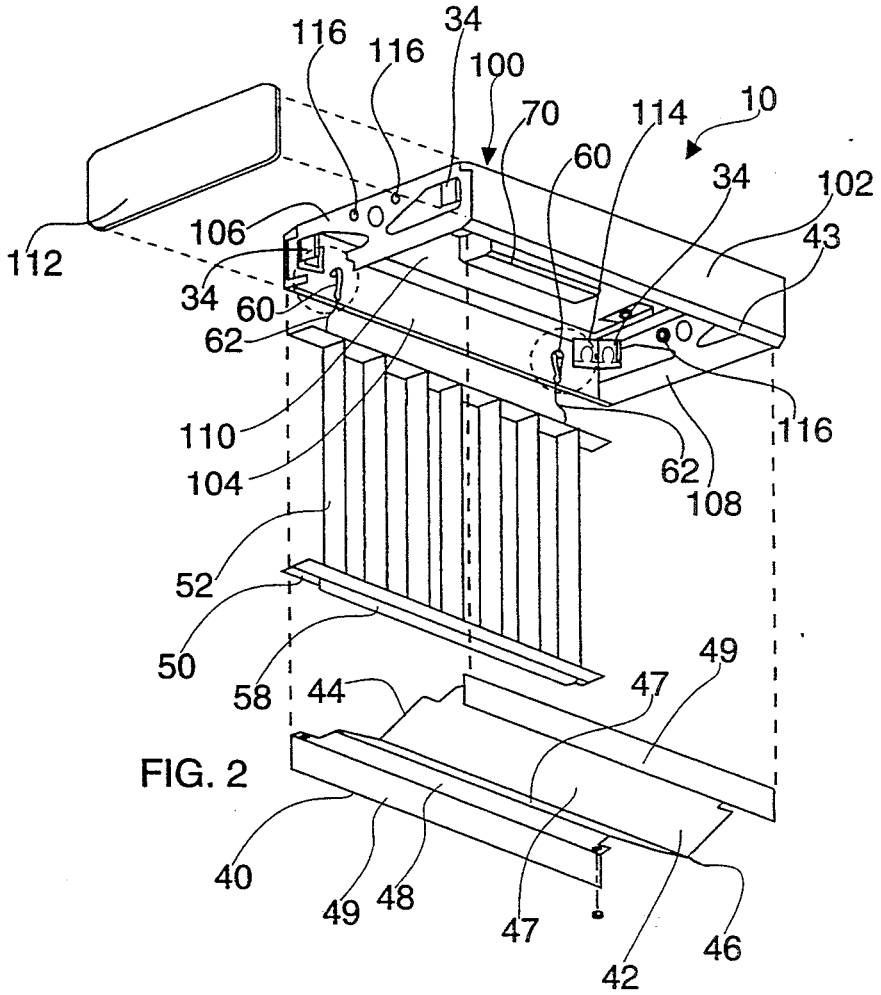
FIG. 2 is an exploded perspective view of the luminaire fixture shown in FIG. 1.

The luminaire fixture of the present invention, indicated generally as 10 in FIGS. 1 and 2, comprises a housing generally indicated at 100 having a first side wall 102, a second side wall 104, a top wall 110, a first end wall 106 and second wall 108. The housing 110 is generally rectangular in shape, though the top wall 110 may have an aperture 111 formed by aperture side walls 109 formed along the center of the top wall 110 and aperture end walls 121 and 122. The end walls 106 and 108 are attached to the housing 100 in any manner known in the art.

Positioned within the housing 100, and attached thereto, is a reflector, generally indicated at 40. The reflector 40 is fastened to and retained within the housing 100 by any means known in the art, such as by bolting the reflector 40 to the housing 100. The reflector 40 includes an underside 42 having relatively high reflectivity for reflecting light from fluorescent lamps placed in proximity to the underside 42 of the reflector 40 as hereinafter discussed. The reflector also has a top side 44 which may have a relatively low reflectivity for reflecting light from an upper fluorescent light in an upward direction as is hereinafter discussed.

The reflector 40 is shaped in a generally flattened, elongated V-shape having a point, or depending ridge, 46 positioned along the center thereof. The reflector 40 is symmetrical about the length of the point 46. Angled walls 47 begin at the point 46 and extend upward and outward from the point 46 to form the V-shape of the reflector 40. Extending from the angled walls 47, at the far ends thereof, are horizontal walls 48 which extend for a short distance in a generally horizontal direction. Then, the reflector 40 is bent down forming a 270° angle with the horizontal portion to form end walls 49. Also, angled wall 51 could be positioned between horizontal wall 48 and end walls 49.

The reflector 40, as such comprises two generally triangular areas which meet at the point 46 of the reflector 40. The end walls 49 form the base of the triangular areas, the angled walls 47 from the hypotenuse and an imaginary line from the point 46 to end walls 49 form the third side. Light sources are positioned within these generally triangular areas, towards the outer ends of the reflector 40, i.e. towards the base of the triangles or end walls 49 of the reflector 40. Additionally, a light source may be positioned above the reflector 40 for directing light in an upward direction.

Figure 7:
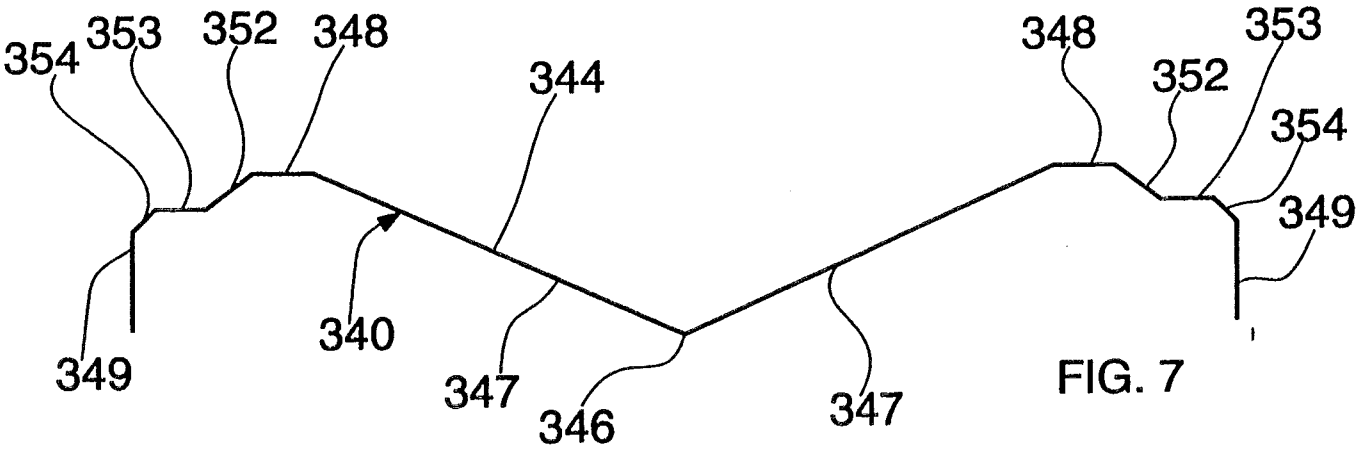
FIG. 7 is another embodiment of the reflector for the luminaire fixture of the present invention.

In another embodiment of the invention, as shown in FIG. 7, the reflector 340 could have a more sophisticated shape. As such, the reflector, again, comprises a generally flattened, elongated, V-shape having a point 346 positioned along the center thereof. The reflector 340 is symmetrical about the length of point 346. Angled walls 347 extend from the point 346 upward and outward to form the V-shape of the reflector 340. Extending from the angled walls 347, at the far ends thereof, are horizontal walls 348 which extend a short distance in a generally horizontal direction. Extending from the horizontal walls 348 are downwardly angled walls 352 which extend a short distance to second horizontal walls 353. These second horizontal walls 353 extend for a short distance and join second angled walls 354 which extend a short distance to end walls 349 which extend horizontally down from the second angle walls 354 to terminate approximately along the same plane as the point 346.

As such, this embodiment of the reflector, 340 like the embodiment of the reflector shown in FIG. 1 and generally indicated as 40, comprises two generally triangular areas which meet at the point 346 of the reflector 340, the end walls 349 forming the base of the triangle and the angled walls 347 forming the hypotenuse and an imaginary line from the point 346 to the end wall 349 forming the third side.

The luminaire fixture 10 of the present invention further includes a louver generally indicated at 50. The louver 50 is attached within the housing 100 below the lamps 30 and 32. The louver 50, may include cross slats 52 and end slats 58. These slats 52 and 58 can be configured in any manner known in the art and can help direct the light from the light sources within the luminaire fixture 10. The louver 50 can be connected to the housing 100 in any manner known in the art. The louver 50 may include louver connecting means 60 connected within the housing 100, at the side walls 102 and 104 from which extend louver attachment cables 62 which are attached to the louver 50 so that the louver 50 can be removed from its position within the housing 100 to hang from the housing 100 by the louver attachment cables 62 so that light sources 30 and 32 can be reached for changing or cleaning.

In the embodiment of the invention shown in FIG. 1, the luminaire fixture 10 includes two light sources 30 and 32. These are typically elongated fluorescent lamps but could be alternative light sources. In one embodiment, the lamps 30 and 32 are positioned below the reflector to reflect light downward along arrows B. The light sources are fixed within the housing by means of light sockets 34 mounted on light brackets 115. Positioned above the reflector 40 and within the aperture 111 of top wall 110 formed by depending walls 109, is an upper light source 20 for reflecting light upward along the direction of arrows A. Again upper lamp 20 is attached within housing 100 by means of light sockets 34 attached to the aperture end walls 121 and 122 of housing 100. This configuration of the luminaire fixture 10 of the present invention provides light to shelves placed in aisles whereby the shelves are evenly lit along the entire height thereof. Further, the up light 20 directs light in an upward direction to illuminate the ceiling above the aisle.

In this embodiment the down light sources are positioned end to end at 30 and 32. However, up light 20 includes only one light bulb and is positioned at a mid point along the length of the housing 100. As such, four light bulbs comprise down lights 30 and 32 and one light bulb comprises up light 20.

In the embodiment of the invention shown in FIG. 2, the reflector 40 and housing 110 is used with lower light sources 30 and 32 only. Positioned above the reflector 40, and mounted to the top wall 110 of the housing 100 is ballast 70. It should be noted that one or more ballast may be required for the lamps used in the fixture. A plurality of ballasts may be mounted to the top wall of the housing. This ballast may be mounted in any manner known in the art.

In the embodiment of the invention shown in FIG. 1, containing at least one up light 20, the ballast 70 would be positioned within the housing either fore or aft of the up light 20 and along the axis of the up light 20. Again, the ballast would preferably be mounted to the top wall 110 of the housing 100. Typically in such an embodiment two down lights 30 and 32 are used along each side of the reflector 40, the lights being positioned end to end and extending the length of the housing 100. In such an embodiment, typically there would be one up light 20 and it would be positioned at a central location of the housing 100.

Figure 3:
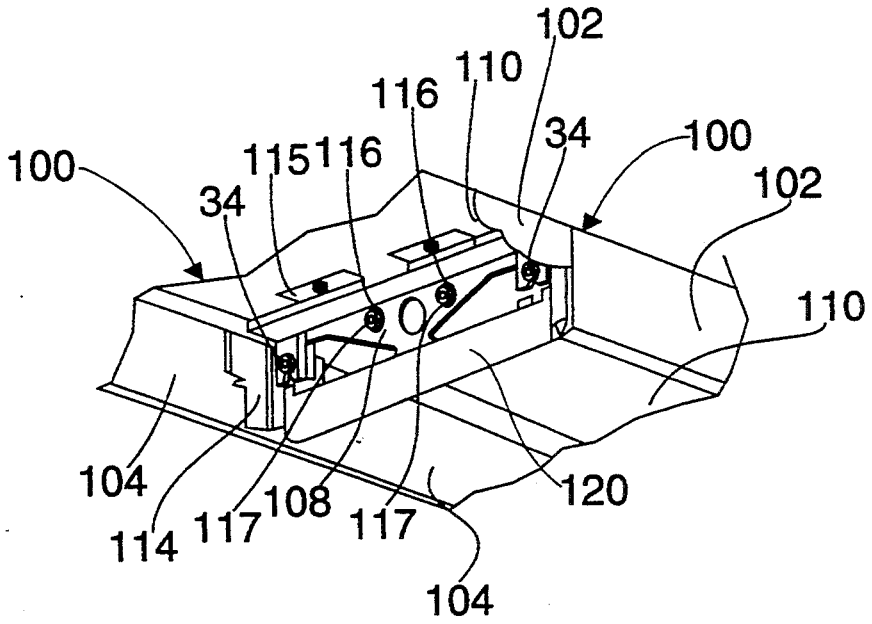
FIG. 3 is a perspective view of one end of the luminaire fixture shown in FIG. 2.

As shown in detail in FIG. 3, the end wall 108 is attached to the side wall and top wall 104 and 110. Light sockets 34 are mounted to the light bracket 115 to receive and hold the lamps 30 and 32 and provide connections for carrying electricity to the lamps 30, and 32. Connection apertures 116 are provided so that bolts 117 may be positioned through adjacent end walls 108 to secure the end walls together to attach fixtures 10 to each other to extend continuously along the length of an aisle. Alignment splines (not shown) may be used to align adjacent fixtures. These alignment splines sit in off sets between adjacent fixtures. Housing joiner blades 120 are provided to extend about adjacent end walls 106 and 108 to provide additional means of attachment of adjoining fixtures 10 and to provide a visually pleasing effect to a viewer by simulating a lower blade.

Alternatively, a finishing end wall 112 may be applied to any exposed walls 106 or 108. The attachment of the finishing end wall 112 is by bolts (not shown) extending from the finishing wall 112 through the connection apertures 116, or by any other means known in the art. Studs may be welded to the inside of the finishing wall to preserve the finish of the exterior of the finishing wall. Any fixtures 10 used independently of other fixtures could have finishing end walls 112 on each side of the fixture 10.

Figure 4:
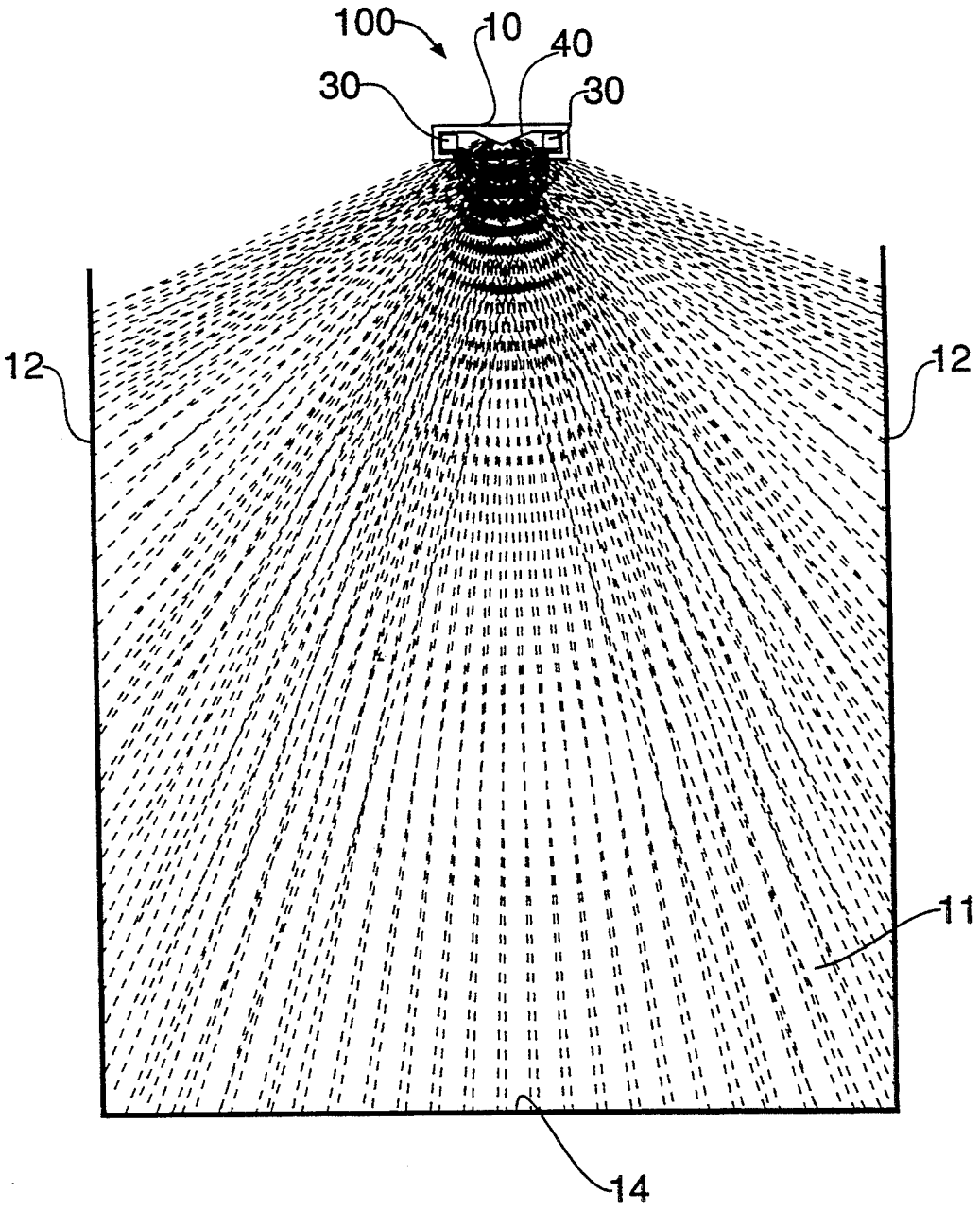
FIG. 4 is a light diagram showing a ray trace of the downward component of the luminaire fixture shown in FIG. 2.

As shown in FIG. 4, the luminaire fixture of the present invention 10 is suspended over the aisle 11 formed by shelves 12. The light sources 30 and 32 in connection with the reflector 40 and the louver 50 provide evenly distributed light to the entire height of the shelves 12 and to the floor 14.

Figure 5:
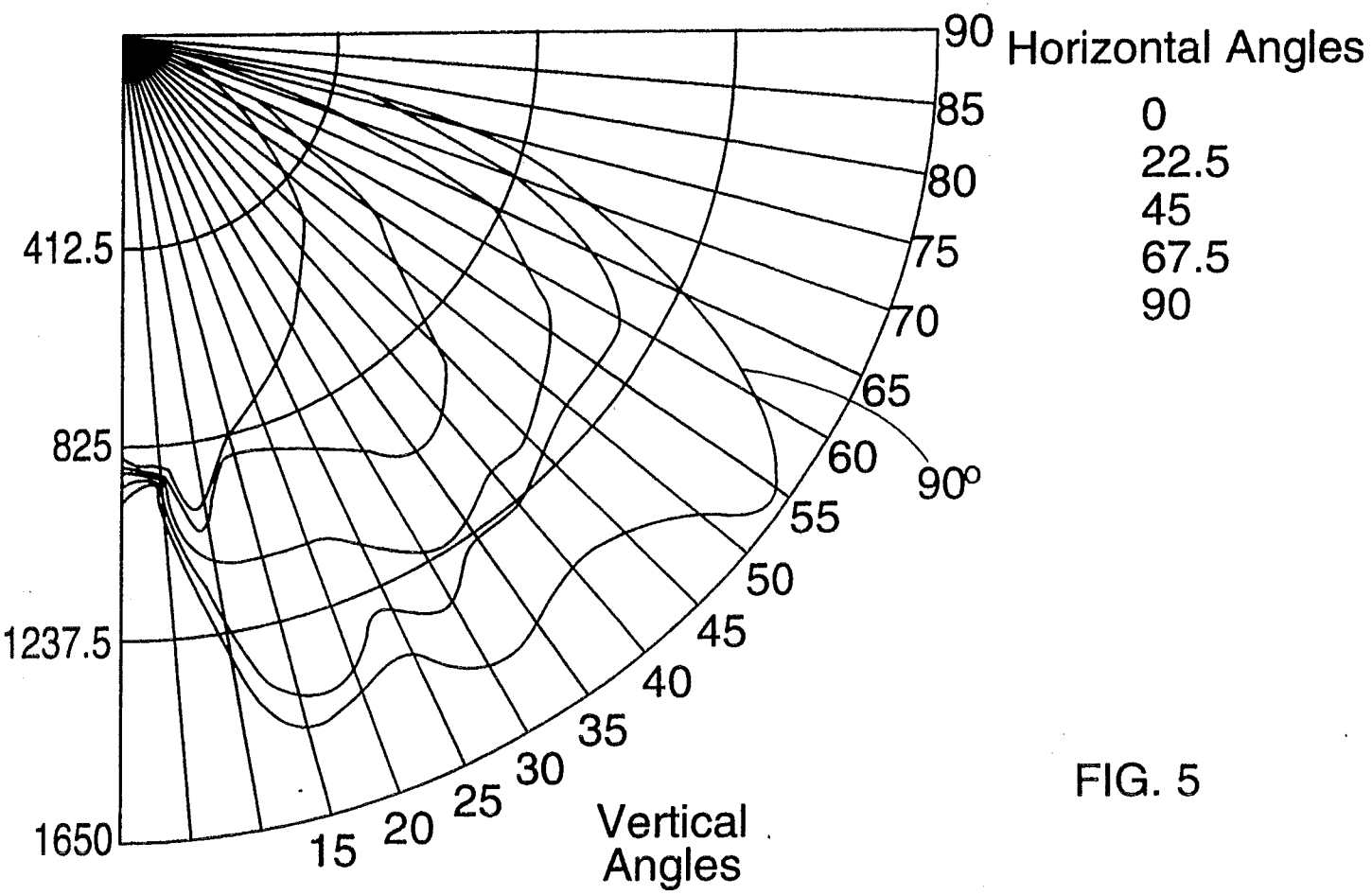
FIG. 5 is a polar candela plot of the downward component for the luminaire fixture shown in FIG. 2.

FIG. 5 shows the polar candela plot for the luminaire fixture of the present invention. This plot provide a visual representation of the pattern of light from the luminaire fixture. In this particular case, since the fixture is symmetrical, only one quarter of the entire plot of the fixture is shown. At 90°, which is perpendicular to the lamps, the pattern of light from the luminaire. The plot of 90° gives the profile of light from the fluorescent lamp and reflected from the reflector at 90° from the lamps. At zero degrees, the plot shows the light from the end of a lamp where the shape of the reflector almost doesn't matter, and there is a smooth curve.

Figure 6:
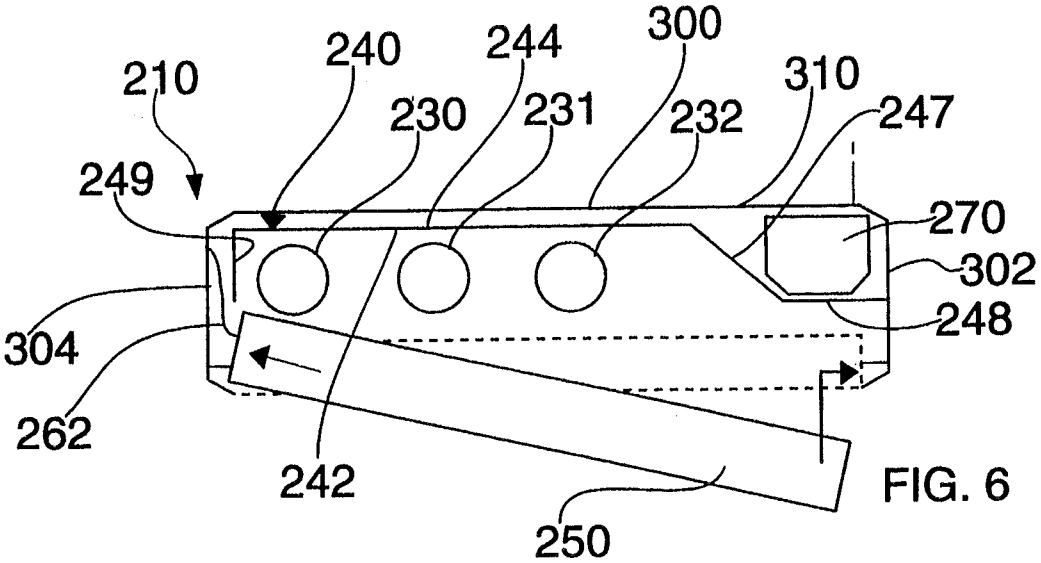
FIG. 6 is a cross-sectional view of another embodiment of the luminaire fixture of the present invention.

As shown in FIG. 6, there is another embodiment of the present invention for lighting the ends of aisles. This embodiment is indicated generally as 210 and includes a housing generally indicated at 300 having a first side wall 302, a second side wall 304, and a top wall 310. The housing 310 is generally rectangular in shape and is of generally the same size as the housing 100 shown in the embodiment of FIGS. 1 and 2.

Positioned within the housing 310 and attached thereto, is a reflector generally indicated at 240. The reflector 240 is fastened to and retained in the housing 300 by any means known in the art, such as by bolting the reflector 240 to the housing 300. The reflector 240 includes an underside 242 having a relatively high reflectivity for reflecting light from a fluorescent lamps placed in proximity thereto. The reflector has a vertical end wall, a horizontal main wall extending over the fluorescent light bulbs, an angled wall 247 angled down at one end thereof and a partial horizontal wall 248 extending from the angled wall 247 to the edge of the housing 300. A ballast 270 may be positioned within the area formed between the upper wall 310 and side wall 302 of the housing 300 and the angled wall 247 and partial horizontal wall 248 of the reflector 240.

The luminaire fixture of this embodiment further includes a louver generally indicated at 250. The louver 250 is attached within the housing 310 below the light sources 230, 231, and 232. The louver may include cross slats and end slats, which may be configured in any manner known in the art. The louver 250 can be connected to the housing 310 in any manner known in the art, and may include louver attachment cables 262 to attach the louver 250 to the housing 310.

The embodiment of the invention shown in FIG. 6 includes three light sources 230, 231 and 232. These light sources are typically elongated fluorescent lamps, though they could be alternative light sources. The lamps 230, 231 and 232 are positioned below the reflector 240 to provide light in a downward direction. The reflector is configured to direct the light from the lamps 230, 231 and 232 in a generally downward direction and at one angle, i.e. toward the angled portion 247 of the reflector 240. In this manner, this luminaire fixture 210 can be mounted at the end of an aisle, or at a far wall of an aisle, to provide light downward and towards the end of the aisle to illuminate the ends of the aisles.

The embodiments of the invention set forth herein may be altered without exceeding the scope of the invention. Additionally, the fixtures may be positioned in any manner desired to provide light in any manner desired. Typically, the fluorescent lamps that would be used in the present invention would be T8 or T10 as known in the trade. T8 lamps are thirty two watts and one inch in diameter. T10 lamps are forty watts and one and a quarter inch in diameter. However, any fluorescent lamps could be used in the fixtures. Additionally, typically four foot lamps would be used in the fixtures discussed herein. In the embodiment of the invention shown in FIG. 1, two four foot lamps would be placed end to end at each side of the lamp, i.e. at 30 and 32. An additional four foot lamp would be positioned at 20 which would be placed along the center axis of the fixture 10 at the center of the length thereof. Typically, two or three ballasts would be needed for each fixture. The ballast would be placed along the center line of the housing, i.e. along the axis of fluorescent bulb 20, either fore or aft of the lamp 20.

The housing is made of commercially available metal which is well known in the art and available from many commercial manufacturers. One such reflector material is sold in flat sheets under the trade name SPECULAR+ by Pre Finish Metals, Inc. in Illinois. SPECULAR+ is a product consisting of silver-metalized polyester plastic film laminated to a metal substrate. The non-reflective surface may be painted a white color to provide a low reflectivity for the up light. The reflector is bent on a metal break to form it into the shapes set forth herein. Other reflector materials can also be used.

The embodiment of the invention shown in FIGS. 1 and 2 is preferably placed approximately eight feet six inches above the floor. The shelves forming aisles in commercial settings are typically six and a half feet high and the width of the aisles formed by the shelf is typically seven feet. The position of the present invention is typically placed along the center line of the aisle directly between the shelves and slightly above the shelves. As such, the luminaire fixture lights the shelves as shown in the ray trace diagram contained in FIG. 4 from the top shelf to the floor.

Having thus described my invention in detail, it is to be understood that the foregoing description is not intended to limit the spirit and scope thereof. What is desired to be protected by Letters Patent as set forth in the appended claims.

What is claimed is:

1. A reflector for a luminaire fixture comprising:
a metal sheet having a top side and a bottom side, the top and bottom sides having a reflective material thereon, the sheet formed into a V-shape having:
a point formed along the center of the sheet;
first angled walls extending up from the point;
horizontal walls extending from the first angled walls, the first angled walls extending for a relatively long distance with respect to the horizontal walls which extend for a relatively short distance;
second angled walls extending from the horizontal walls;
second horizontal walls extending from the second angled walls;
third angled walls extending from the second horizontal walls; and
vertical end walls depending from the third angled walls.

2. A luminaire fixture comprising:
a housing having:
a top wall;
side walls extending from the top wall along sides of the top wall; and
end walls extending from the top wall at ends of the top wall;
a reflector mounted within the housing, the reflector comprising:
a depending ridge formed along the center thereof;
angled walls extending up from the depending ridge and out toward the side walls of the housing;
horizontal walls extending horizontally from the angled walls toward the side walls of the housing;
second angled walls extending from the horizontal walls;
second horizontal walls extending from the second angled walls;
third angled walls extending from the second horizontal walls;
vertical walls depending vertically from the third angled walls and extending along the side walls of the housing;
lower light sources removably mounted in the housing and positioned under the reflector on each side of the depending ridge of the reflector and within the vertical walls of the reflector;
depending walls from the top wall of the housing forming a border defining an aperture in the housing; and
an upper light source removably mounted within the aperture of the housing and positioned above the reflector and over the depending ridge of the reflector.

3. The apparatus of claim 2, wherein the lower light sources each include fluorescent lamps positioned at sides of the depending ridge of the reflector.

4. The apparatus of claim 3, wherein the upper light source comprises a fluorescent lamp positioned over the depending ridge of the reflector.

5. The apparatus of claim 4 further comprising means in the housing for receiving and mounting a ballast, said means positioned at an end of the housing.

6. The apparatus of claim 5 further comprising louver means removably mounted within the housing below the lower light sources for directing the light from the lower light sources.

7. The apparatus of claim 6 further comprising louver cables extending between the side walls of the housing and the louver to tether the louver to the housing.

8. The apparatus of claim 7, wherein the end walls of the housing include means for attaching the housing to other housings to form a series of attached fixtures.

9. A luminaire fixture comprising:

a housing having:

a top wall;

side walls extending from the top wall along the sides of the top wall; and end walls extending from the top wall at the ends of the top wall;

a reflector mounted within the housing, the reflector comprising:

a depending ridge formed along the center thereof;

angled walls extending up from the depending ridge and out toward the side walls of the housing;

horizontal walls extending horizontally from the angled walls toward the side walls of the housing;

vertical walls depending vertically from the horizontal walls and extending along the side walls of the housing;

lower light sources removably mounted in the housing and positioned under the reflector on each side of the depending ridge of the reflector within the vertical walls of the reflector;

depending walls from the top wall of the housing forming a border defining an aperture in the housing; and an upper light source removably mounted within the aperture of the housing and positioned above the reflector and over the depending ridge of the reflector.

10. The apparatus of claim 9, wherein the lower light sources each include fluorescent lamps positioned end to end at each sides of the depending ridge of the reflector.

11. The apparatus of claim 10, wherein the upper light source comprises a fluorescent lamp positioned over the depending ridge of the reflector.

12. The apparatus of claim 11 further comprising means in the housing for receiving and mounting a ballast, said means positioned at an end of the housing.

13. The apparatus of claim 12 further comprising louver means removably mounted within the housing below the lower light sources for directing the light from the lower light sources.

14. The apparatus of claim 13 further comprising louver cables extending between the side walls of the housing and the louver to tether the louver to the housing.

15. The apparatus of claim 14, wherein the end walls of the housing include means for attaching the housing to other housings to form a series of attached fixtures.

* * * * *